United States Patent [19]

Lieberman

[11] Patent Number: 4,545,290

[45] Date of Patent: Oct. 8, 1985

[54] PRESSURE CYLINDER

[75] Inventor: Walter G. Lieberman, Minneapolis, Minn.

[73] Assignee: Tol-O-Matic, Inc., Minneapolis, Minn.

[21] Appl. No.: 564,990

[22] Filed: Dec. 23, 1983

[51] Int. Cl.[4] ..... F01B 29/00; F01B 9/00

[52] U.S. Cl. ..... 92/88; 92/138; 244/63

[58] Field of Search ..... 92/88, 138; 244/63

[56] References Cited

U.S. PATENT DOCUMENTS

| | | | |
|---|---|---|---|
| 2,109,128 | 2/1938 | Carrillo | 92/88 |
| 2,502,487 | 4/1950 | Scholl | 92/88 |
| 2,686,497 | 8/1954 | Dooley | 92/88 |
| 3,421,718 | 1/1969 | Gehringer et al. | 92/88 |

FOREIGN PATENT DOCUMENTS

| | | | |
|---|---|---|---|
| 68088 | 1/1983 | European Pat. Off. | 92/88 |
| 470088 | 8/1937 | United Kingdom | 92/88 |

*Primary Examiner*—Paul E. Maslousky

*Attorney, Agent, or Firm*—Dorsey & Whitney

[57] ABSTRACT

A fluid pressure cylinder of the rodless type having a reciprocally movable piston, an elongated slot within the cylinder and an improved sealing element for successively sealing the elongated slot during movement of the piston. The improved sealing element is constructed of a generally flexible material and includes a sealing portion for creating a seal against the inner side wall of the cylinder adjacent to the elongated slot and a portion which is adapted for at least partial insertion wthin the slot so as to retain the seal member within the slot during an absence of pressure within the cylinder.

45 Claims, 11 Drawing Figures

PRESSURE CYLINDER

BACKGROUND OF THE INVENTION

The present invention relates generally to a fluid pressure cylinder, and more particularly, to an improved fluid pressure, rodless cylinder of the type having a cylinder with an enlongated, longitudinally extending slot, a piston reciprocally movable within the cylinder and an improved sealing means for successively sealing the slot during reciprocal movement of the piston.

Pressure cylinders, and in particular rodless, pressure cylinders, have existed in the art for many years. In general, a rodless fluid pressure cylinder includes an enlongated cylinder with a slot extending along the wall of the cylinder in an axial direction. A piston member is disposed within the cylinder for reciprocal back and forth movement along the length of the cylinder. Such movement is controlled by the introduction of hydraulic or pneumatic fluid pressure into chambers at the ends of the cylinder on each side of the piston. Such cylinders also include means for transferring the reciprocal movement of the piston to an external workpiece. In a rodless cylinder this means normally includes a bracket connected directly with the piston and having a portion extending outwardly through the elongated slot for connection with the work piece. Because of this elongated slot in the cylinder element, a seal member is needed to seal the pressure chambers in the opposite ends of the cylinder to prevent the fluid pressure from escaping through the slot.

One prior art structure is shown in U.S. Pat. No. 3,820,446. The device of this patent contemplates the use of a flat sealing member having magnetic properties which is adapted for engagement with the inside surface of the cylinder on opposite sides of the slot. The sealing member in this patent is retained in this sealing position by a plurality of magnet elements embedded within the cylinder wall. A second prior art structure is shown in U.S. Pat. No. 4,373,427. This patent contemplates that the cylinder wall will be made of steel or other material having magnetic properties and that the elongated sealing member would be a relatively flat member having a portion constructed of a rubberized magnet for attraction to the steel wall.

While both of these prior art structures as well as others have performed satisfactor:ly in certain applications, there continue to be ways in which fluid pressure cylinders of this type can be improved. For example, efforts are continually being made to improve the sealing relationship between the elongated sealing member and the portions of the cylinder wall dividing the elongated slot. Further, efforts are also continually being made to increase the life and wearability of the seal member since such seal must be able to withstand millions of cycles without failing. Finally, efforts are always being made to construct an improved fluid pressure cylinder at a reduced cost. Thus, a need continues to exist in the art for a power cylinder having the above-mentioned improvements and features.

SUMMARY OF THE INVENTION

The present invention relates generally to a fluid pressure cylinder of the rodless type having an elongated cylinder with an elongated slot, a reciprocally movable piston and a seal means for successively sealing the slot during movement of the piston. The seal member structure of the present invention provides for significantly improved sealing capabilities between such member and the cylinder wall adjacent to the elongated slot. The present invention also includes improved means for maintaining the sealing portion of the seal means in sealing engagement with the cylinder wall when no pressure is present within the pressure chambers. The structure of the present invention also embodies a sealing member which is durable and able to withstand the repeated cycles of a pressure cylinder. Finally, the sealing means of the present invention embodies a structure which facilitates significant reduction in manufacturing costs.

More particularly, the sealing member of the present invention includes an elongated section of generally flexible material having a first or sealing portion for engagement in sealing relationship with the inner cylinder wall adjacent to the elongated slot. The sealing member also includes a second or retaining portion for insertion into a portion of the elongated slot so as to properly align the sealing member with the inner edges of the cylinder wall and to retain the same in sealing relationship in the absence of internal pressure within the cylinder chambers. The device of the present invention also includes a means for successively inserting a portion of the sealing member into the elongated slot and withdrawing the same from the elongated slot during back and forth reciprocal movement of the piston element. Means are also provided in the form of a force transfer bracket having a portion connected directly to the piston and a portion extending through the slot for connection to the workpiece. The force transfer bracket is adapted for reciprocal movement with the piston along the longitudinal axis of the cylinder.

Although the sealing means of the present invention can be constructed from a variety of different materials, the preferred embodiment of the present invention contemplates a sealing means constructed of two different materials. One portion of the sealing strip, namely, a support section of the first or sealing portion is intended to be constructed from a material which is resistent to oil, which does not stretch significantly and which has a relatively high elastic modulus and tensile strength. A second portion of the sealing strip, namely, a sealing section of the first or sealing portion and the second or retaining portion, is intended to be constructed from a much more flexible and compressible material than the sealing portion, but which also exhibits a high resistance to oil and other solvents. Means are also provided in the pressure cylinder of the present invention for guiding the elongated sealing strip out of the elongated slot and means for inserting a portion of the elongated sealing strip into the slot. In the preferred embodiment, these means include a plurality of rollers which are rotatably secured with respect to the force transfer bracket. Means are also provided in the form of a groove in the side edges of the slot for aiding the retention of the seal member within the slot when no pressure is present.

The preferred embodiment of the present invention also contemplates the use of a dust band or the like to cover the exterior surface of the elongated slot where desired.

Accordingly, it is an object of the present invention to provide a fluid pressure cylinder of the rodless type having an improved elongated sealing member.

Another object of the present invention is to provide a fluid pressure cylinder having an elongated sealing means with improved sealing characteristics.

A further object of the present invention is to provide a fluid pressure cylinder having improved wear characteristics.

Another object of the present invention is to provide an improved sealing means for a rodless cylinder which results in reduced manufacturing cost, but which still has the durability to tolerate the presence of sand, dirt and other foreign materials without causing leakage of the cylinder.

A further object of the present invention is to provide an improved sealing member for an elongated slot of a rodless cylinder which includes an improved sealing portion and an improved means for retaining the sealing member within the slot when no fluid pressure is present.

Another object of the present invention is to provide an improved sealing member which is constructed of two different materials.

These and other objects of the present invention will become apparent with reference to the drawings, the description of the preferred embodiment and the appended claims.

DESCRIPTION OF THE PREFERRED EMBODIMENT

Figures 1, 9, 10, 11:
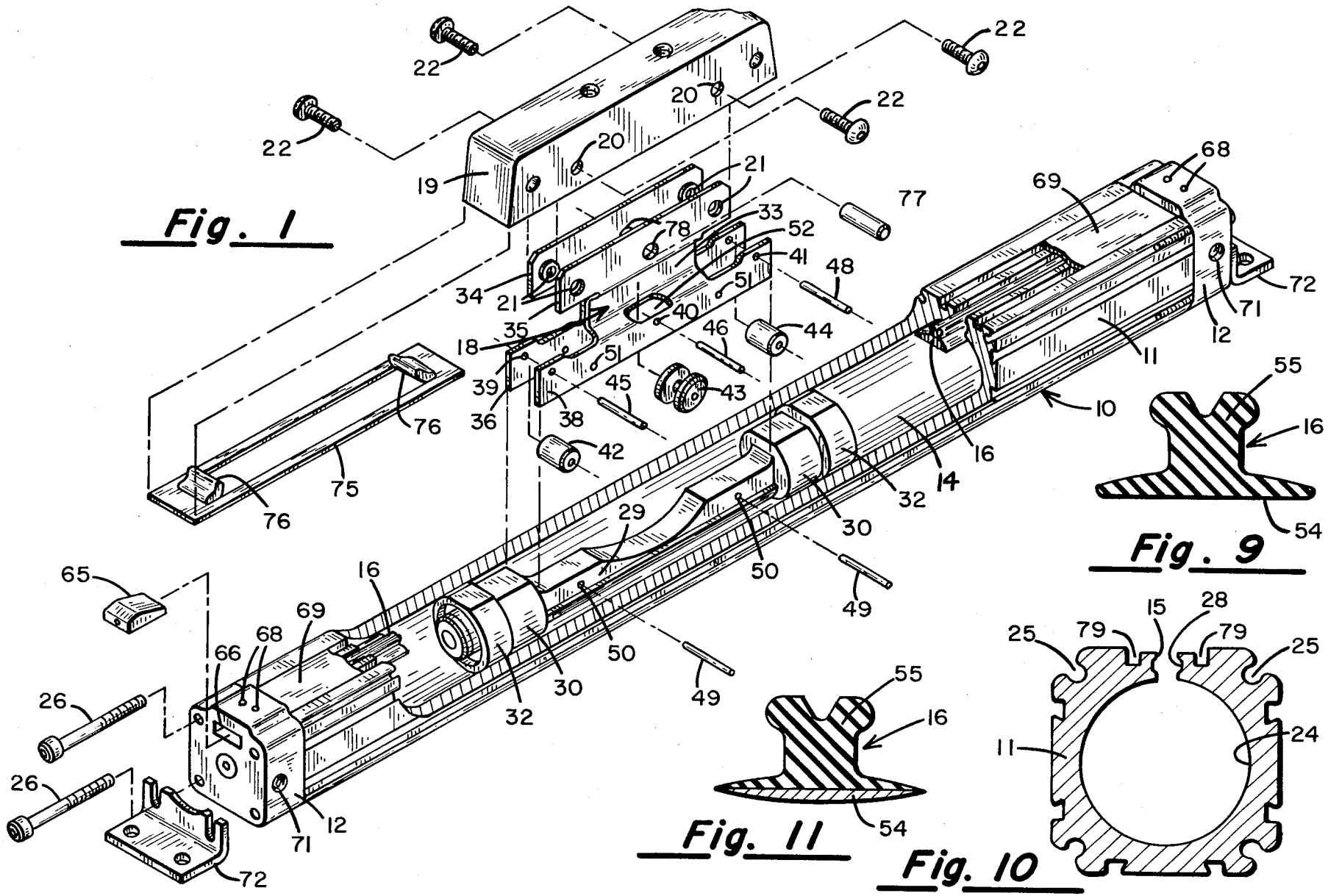
FIG. 1 is a pictorial view of the fluid pressure cylinder of the present invention with portions removed and broken apart.
FIG. 9 is a cross-sectional view of an alternate embodiment of the elongated sealing member.
FIG. 10 is a cross-sectional view of the tubular cylinder portion of the present invention.
FIG. 11 is a cross-sectional view of an alternate seal member construction.

Reference is first made to FIG. 1 in which the fluid pressure cylinder is indicated generally by the reference numeral 10. As illustrated, the fluid pressure cylinder 10 includes an elongated, generally tubular cylinder element 11, a pair of end caps or head assemblies 12, 12 and a piston element 14 disposed within the interior of the cylinder 11 and adapted for reciprocal back and forth movement. A side surface of the cylinder is provided with an elongated slot 15 extending the entire length of and in a direction parallel to the longitudinal axis of the cylinder 11 for receiving an elongated sealing member 16. An elongated dust cover 69 is also provided to cover the slot 15. The sealing member 16 and dust cover 69 are secured at their ends to a portion of the head assemblies 12, 12 in the manner illustrated in FIGS. 1 and 2. Specifically, the member 16 and cover 69 extend through an opening 66 in each of the end assemblies 12, 12 and are retained in that position by a wedge member 65 and a pair of set screws 68.

The sealing member 16 is adapted for insertion into and withdrawal from the slot 15 during reciprocal movement of the piston 14. The cylinder of the present invention also includes a force transfer bracket 18 which is connected with the piston 14 and which includes a portion extending through the elongated slot 15 for connection with a workpiece (not shown). A portion of the transfer bracket 18 is housed within the cover 19 which includes a plurality of holes 20 which mate with corresponding threaded openings 21 in an upper portion of the bracket 18. A plurality of screws 22 extend through the holes 20 and are received by the threaded openings 21 to secure the cover 19 to the bracket 18.

Figure 6:
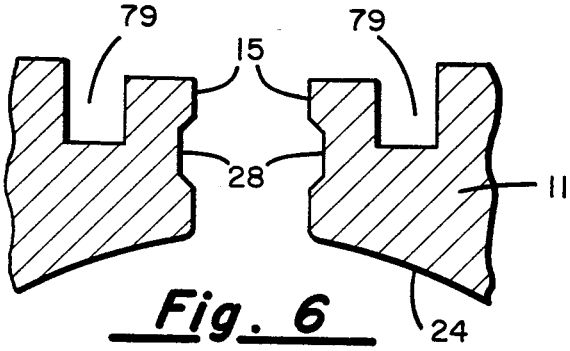
FIG. 6 is a cross-sectional view of a portion of the fluid pressure cylinder of the present invention showing the elongated slot.
Figure 7:
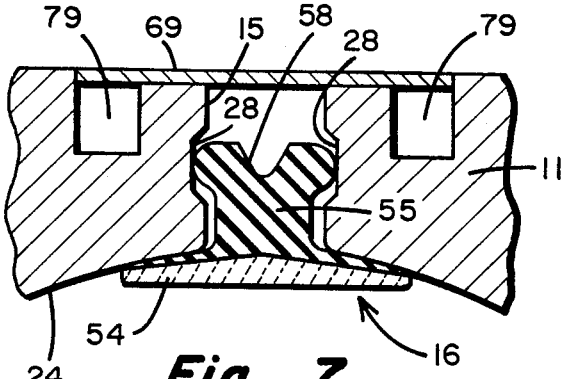
FIG. 7 is a cross-sectional view of a portion of the fluid pressure cylinder of the present invention showing the elongated slot and the improved sealing strip disposed therein in sealing relationship.

With continuing general reference to FIG. 1, and more specific reference to FIGS. 6, 7 and 10, the cylinder 11 includes a hollow, generally cylindrically shaped interior surface 24 extending throughout its entire length. In the preferred embodiment, the interior surface 24 has a circular cross-sectional configuration. The exterior surface of the cylinder 11 includes a plurality of longitudinally extending recessed portions 25 adapted to receive conventional self-tapping or other screws 26 extending through the head assemblies 12, 12. By tightening the screws 26, the head assemblies 12, 12 are secured tightly to the ends of the cylinder 11. An appropriate sealing means such as an "O" ring 70 (FIG. 2) or other means conventional in the art is utilized to form a seal between the head assemblies 12, 12 and the cylinder 11. Openings 71, 71 are provided in each of the head assemblies 12, 12 for causing the introduction of air or other fluid into and the exhaust of air or other fluid out of the interior of the cylinder 11 in a manner known in the art. A bracket 72 is connected with each end 12 for mounting the cylinder to a desired frame or other means.

The elongated slot 15 disposed in one side of the cylinder is of fixed width and extends throughout the entire length of the cylinder 11 in a direction generally parallel to its longitudinal axis. As illustrated best in FIGS. 6 and 7, the slot 15 is preferably provided with a groove or recessed portion 28 along each side edge of the slot 15. Similar to the slot 15, the recessed portions 28 extend the entire length of the cylinder 11. As will be described in greater detail below, the purpose of these recessed portions 28 is to assist in retaining the elongated sealing member 16 within the slot 15 when no pressure is exerted on the inside of the cylinder. It should be noted that the bottom edges of the slot 15 join with the interior surface 24 of the cylinder 11. It is contemplated that the cylinder 11 of the present invention can be constructed of a variety of materials; however, in the preferred embodiment, the cylinder is constructed of an extruded aluminum.

Figure 2:
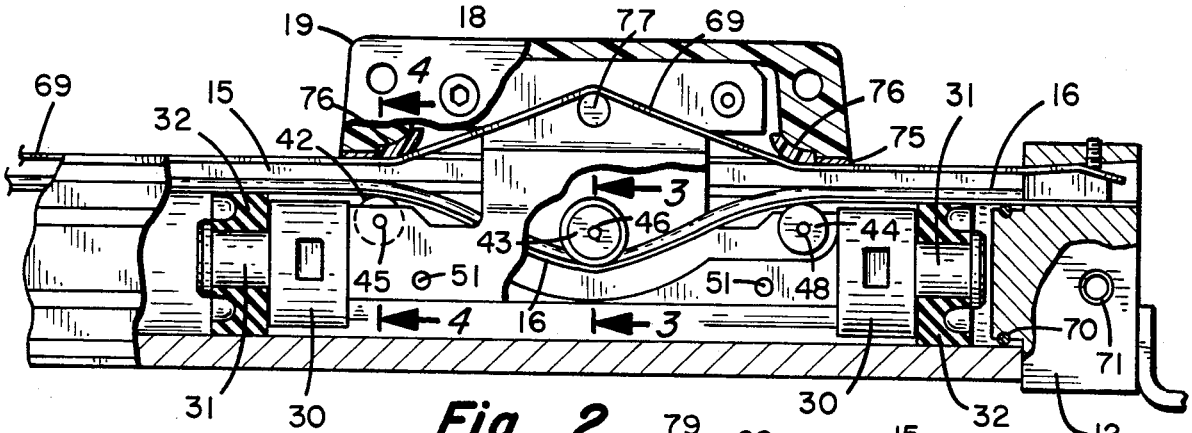
FIG. 2 is a side view, partially in section, of the fluid pressure cylinder of the present invention.
Figure 3:
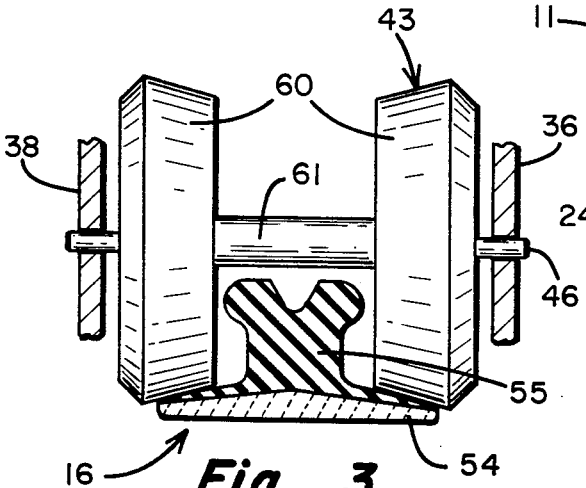
FIG. 3 is a view, partially in section, as viewed along the section line 3—3 of FIG. 2.

Reference is next made to FIGS. 1 and 2 illustrating the piston assembly 14. The piston assembly 14 includes an elongated piston body 29 extending between a pair of piston end portions 31, 31. Mounted on each of the end portions 31, 31 in a conventional manner is a seal member 32. Although various kinds of seals can be used for this purpose, the preferred embodiment of the present invention contemplates that the seal members 32, 32 will be conventional cup seals. Positioned adjacent to the seal members 32, 32 are a pair of seal backing members 30, 30 connected to the piston body 29. The members 30, 30 function to keep the piston centered within the cylinder. When fully assembled, the seal members 32, 32 form a sealed relationship with the interior surface 24 of the cylinder 11.

Operatively connected with the piston 14 and extending through the elongated slot 15 is a force transfer and roller support bracket 18. This bracket 18 is illustrated best in FIGS. 1 and 2. As shown, the bracket 18 includes a pair of bracket half sections 34 and 35 which are secured together by welding or the like near their midpoint. Each of the half sections 34 and 35 includes lower, spaced apart portions 36 and 38, respectively. These portions 36 and 38 include a plurality of openings 39, 40 and 41 to rotatably mount the guide and support rollers 42, 43 and 44, respectively. The guide roller 43 is rotatably supported between the lower portions 36 and 38 by a pin 46 extending through the openings 40, while the rollers 42 and 44 are rotatably supported between the portions 36 and 38 by the the pins 45 and 48, respectively, extending through the openings 39 and 41. The entire bracket 18 is fixedly secured to the main piston body 29. by a pair of connecting pins 49, 49 extending through the holes 51, 51 in the bracket 18 and corresponding holes 50, 50 in the piston body 29. An opening 52 is provided in each of the portions 36 and 38 to permit rotation of the guide roller 43. When properly assembled within the cylinder as illustrated in FIG. 2, the central portion of the bracket 18 extends outwardly through the elongated slot 15.

Figure 4:
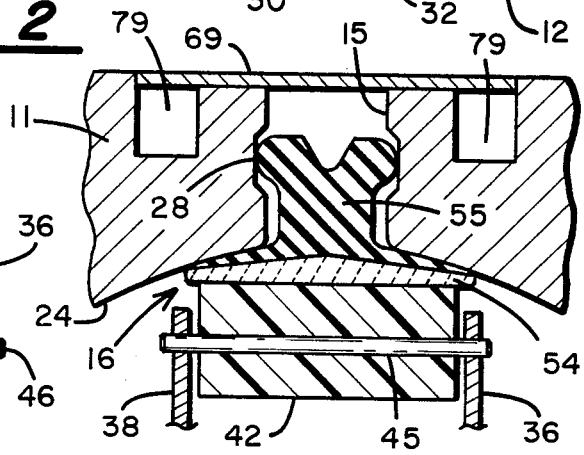
FIG. 4 is a view, partially in section, as viewed along the section line 4—4 of FIG. 2.
Figure 5:
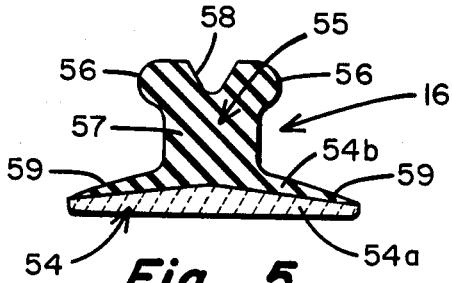
FIG. 5 is a cross-sectional view of the improved elongated sealing member of the present invention.

The improved seal member 16 of the present invention is illustrated best in FIGS. 1, 3, 4, 5, 7 and 8. As shown in FIGS. 3, 4, 5, 7 and 8 illustrating cross-sectional configurations, the seal member 16 includes a lower, first or sealing portion 54 and an upper, second or retaining portion 55. With reference to FIG. 5, the sealing portion 54 includes a pair of seal lips 59, 59 which extend outwardly from the central portion of the seal member 16. In the preferred embodiment, the seal portion 54, including the seal lips 59, 59, is comprised of a lower support section 54*a* and an upper seal section 54*b*. The support section 54*a* is generally flat or curved slightly with its center of curvature above the slot and outside of the cylinder to permit sealing engagement with the outer sealing surface of the cup seals 32, 32. The seal section 54*b* comprising the upper surfaces of the lip seal portions 59, 59 is adapted for sealing engagement with a portion of the interior surface 24 of the cylinder 11 (FIGS. 4 and 7) adjacent to the slot 15.

Although the support section 54*a* of the seal member 16 can be constructed from a variety of materials, it is preferable for the section 54*a* to be a relatively flexible material, but one which does not stretch. Thus, it should have a relatively high elastic modulus and high tensile strength. The section 54*a* should also preferably be resistant to oil and heat and other materials which it would normally be exposed to during operation. In the preferred embodiment, the support section 54*a* is constructed from a commercial grade polypropylene having a durometer of between 90 and 110. The preferred durometer is about 100. The elastic modulus of the preferred polypropylene is $2\times10^5$, however, it is believed that materials having a lower elastic modulus will also be effective to some extent. Preferably, however, the elastic modulus of the support section 54*a* should be greater than about $1\times10^5$.

It is also contemplated that the support section 54*a* could be constructed of steel or similar material as shown in FIG. 11. In such a structure, the seal section 54*b* and retaining portion 55 is bonded directly to the upper surface of the steel by a conventional process. It should be noted that the upper surface of the steel support section is flat, while the lower surface is flat or curved such that its center of curvature is above the slot and outside the cylinder when in use. When steel is used as the support section 54*a*, the elastic modulus is $30\times10^6$.

The seal section 54*b* of the portion 54 is normally constructed from a material different than the support section 54*a*. Specifically, the section 54*b* is constructed from a flexible, rubbery material which will form a good seal with the inner surface 24 of the cylinder. This material should also be resistent to oil and other materials to which it will be exposed during operation of the cylinder. In the preferred embodiment, the section 54*b* is constructed of a compressible material such as a natural or synthetic rubber with a durometer of between 50 and 80. The preferred durometer is about 65. As shown in the drawings, the section 54*b* is preferably integrally formed with the retaining portion 55 and also formed of the same material.

The upper, second or retaining portion 55 of the seal member 16 is integrally formed with the sealing portion 54 and adapted for insertion at least partially into the elongated slot 15. The retaining portion 55 includes a neck portion 57 having its lower end integrally formed with the seal section 54*b*. Also, integrally formed with the neck portion 57 are a pair of outwardly extending retaining lip or rib portions 56, 56. These lip or rib portions 56, 56 extend laterally outwardly from the narrowed neck 57 and extend the entire length of the seal member 16. Positioned between the lip portions 56, 56 is an elongated recessed area or groove 58 also extending the entire length of the seal member 16. This groove 58 is sufficiently deep to permit inward flexing of the lip portions 56, 56 and thus insertion of the portion 55 into the slot 55.

Figure 8:
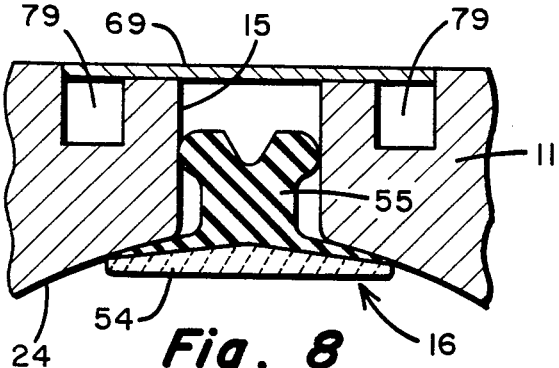
FIG. 8 is a cross-sectional view of the fluid pressure cylinder of the present invention showing an alternate embodiment of the elongated slot and a sealing strip disposed therein.

While various dimensions of the seal members 16 will function satisfactorily in accordance with the present invention, the preferred embodiment shows the neck portion 57 having a width which is less than the width of the elongated slot 15 (FIG. 7). Also the distance between the outermost edges of the lip portions 56, 56 should be greater than the width of the slot 15. With this structure, the lip portions 56, 56 are compressed as the seal member 16 is forced into the elongated slot 15, thus facilitating retention of the seal member 16 within the slot 15. As indicated above, the compression of the lip portions 56, 56 is facilitated by the existence of the elongated groove 58. With some materials and dimensions, the frictional forces between the lip portions 56, 56 and the inner edges of the slot 15 will be sufficient to hold the seal member 16 within the slot 15 when no fluid pressure is exerted in the pressure chambers, even when no retaining grooves are provided in the slot as shown in FIG. 8. In the preferred embodiment, however, the side edges of the elongated slot 15 are provided with a pair of opposed retaining grooves or recessed portions 28 extending the entire length of the cylinder 11. The lip portions 56, 56 are intended to mate with these grooves 28, 28 as shown best in FIGS. 4 and 7 so as to assist in retaining the seal members 16 within the slot 15 when no pressure exists in the chambers. It is also contemplated that the cylinder of the present invention could embody a structure with a groove 28 existing on only one side edge of the slot 15.

Similar to the seal portion 54, the retaining portion 55 can be constructed from a variety of materials. Preferably, the material should be flexible and resistent to oil and other materials to which the seal member 16 will be exposed during operation. The portion 55 should also preferably be compressible so that it can be inserted into the slot 15 by the rollers 42 and 44. This compressibility can be achieved as a result of providing a structure with a groove 58 between the lips 56, 56 as shown in the drawings or by selecting a compressible material such as a natural or synthetic rubber material, or both. Preferably, the durometer of the retaining portion 55 should be between 50 and 80 with the preferred durometer being about 65.

Although the preferred embodiment of the seal member 16 is contemplated as being made of two different materials and joined at the junction between the sections 54*a* and 54*b*, the advantages of the present invention can also be achieved if it is made entirely of the same material. Such structure would still have a sealing portion 54 for sealing engagement with the interior surface 24 of the cylinder 11 and a retaining portion 55 for insertion into the slot 15; however, the material from which it is made would have properties acceptable for both functions.

The means for inserting the retaining portion 55 of the seal member 16 into the elongated slot 15 includes the rollers 42 and 44. These are illustrated best in FIG. 2 showing both rollers and FIG. 4 showing the roller 42 engaging the sealing member 16. As shown in FIG. 4, the roller 42 is rotatably mounted on a pin member 45 between the lower spaced apart mounting portions 36 and 38 of the force transfer bracket 18. During reciprocal movement of the piston 14, the roller 42 engages successive portions of the seal member 16, thereby forcing the same into the elongated slot 15 so that the lip portions 56, 56 seat within the grooves 28, 28 as shown in FIG. 7. The other roller 44 is rotatably mounted on the pin 48 between the portions 36 and 38 to similarly force successive portions of the seal member 16 into the slot 15 during movement of the piston 14. With reference to FIG. 2, as the piston 14 moves toward the right, the roller 42 forces the seal member 16 into the slot 15. As the piston 14 moves toward the left, the roller 44 forces the seal member 16 into the slot 15. Each of the rollers 42 and 44 is generally cylindrical with a cylindrical surface for engagement with the surface on the bottom of the sealing member 16.

Also rotatably mounted between the portions 36 and 38 about the pin 46 is a guide roller 43 which functions to guide successive portions of the seal member 16 out of the slot 15 during movement of the piston 14. As illustrated best in FIG. 3, the roller 43 includes a pair of side roller portions 60, 60 which are laterally spaced apart and integrally formed with a central hub portion 61. The side roller portions 60, 60 are adapted for engagement with the top surfaces of the sealing lips 59, 59. The retaining portion 55 is disposed within the recessed area defined by the central hub 61. As the piston 14 moves reciprocally within the cylinder, the seal member 16 is forced downwardly around the roller 43, thus causing withdrawal of the seal member 16 from the slot 15. This permits the force transfer bracket 18 to extend upwardly through the slot 15.

As shown in FIG. 2, means are also provided for guiding the dust band 69 away from the slot 15. This means includes a guide member 75 having a pair of guide portions 76, 76 and a roller or pin 77 supported between the spaced bracket sections 34 and 35 in the bracket openings 78, 78. These members 75 and 77 guide the band 69 away from and back into engagement with a recessed portion of the cylinder during reciprocal movement of the piston 14. It is contemplated that the band 69 will be constructed of spring steel and that magnet elements may be provided in the grooves 78, 78 to retain the band 69 in its slot.

Having described the preferred embodiment of the present invention in detail, the operation of the cylinder of the present invention can be understood as follows. As fluid pressure is introduced into one of the pressure chambers positioned on either side of the piston 14 through one of the end assemblies 12, 12, the piston 14 will begin to move in a direction opposite the chamber in which the pressure is introduced. This movement of the piston 14 will in turn cause the elongated sealing member 16 to be inserted into the elongated slot 15 on the end of the cylinder into which the pressure is being introduced and will be withdrawn from the elongated slot 15 at the other end. For example, with reference to FIGS. 1 and 2, if fluid pressure is introduced into the chamber to the left of the piston 14, the piston 14 will begin to move toward the right. This movement will result in the roller 42 causing insertion of a portion of the generally flexible sealing member 16 into the elongated slot 15. Also, as a result of movement of the piston 14 toward the right, the roller member 43 will cause the seal member 16 in the direction of movement to be withdrawn from the slot 15. When the piston 14 reaches the opposite end of the cylinder, appropriate valving means (not shown) will cause fluid pressure to be inserted into the chamber on the right-hand slde of the piston 14. This in turn will cause the piston to move toward the left. As a result of this movement, the roller 44 will force a portion of the flexible seal member 16 into the slot 15 and the roller 43 will withdraw the seal member 16 from the slot as it moves toward the left. It has been found that such a structure results in improved sealing relationship between the seal member 16 and the inner surfaces 24 of the cylinder 11 and results in significant reduction of manufacturing costs.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A pressure cylinder comprising:

an elongated tubular member having a side wall, a pair of pressure chambers and an elongated slot extending through said side wall and defined by opposed edge portions of said side wall;

a piston reciprocally movable within said tubular member; and means for successively sealing said slot during movement of said piston including an elongated seal member having a first portion for sealing engagement with a portion of the inner surface of said tubular member on each side of said elongated slot and a second portion for insertion into said elongated slot, said second portion including a retaining portion with a width greater than the width between corresponding side wall portions of said elongated slot so that upon insertion of said second portion into said elongated slot, said second portion will be retained therein as a result of engagement between the retaining portion of said second piston and said side wall portions of said elongated slot.

2. The cylinder of claim 1 wherein said seal member is flexible.

3. The cylinder of claim 2 wherein said first portion comprises a pair of sealing lips for sealing engagement with said portion of the inner surface of said tubuler member.

4. The cylinder of claim 1 wherein said first portion has a width greater than the width of said elongated slot.

5. The cylinder of claim 1 wherein said second portion is compressible to permit insertion into said elongated slot.

6. The cylinder of claim 1 wherein said second portion includes a neck portion connected with said first portion and a retaining portion for insertion into said slot comprising a retaining lip extending outwardly from said neck portion on at least one side thereof.

7. The cylinder of claim 6 wherein said neck portion has a cross-sectional width less than the width of said slot and said retaining portion has a cross-sectional width greater than the width of said slot.

8. The cylinder of claim 7 wherein said retaining portion is compressible to permit insertion into said slot.

9. The cylinder of claim 6 including a retaining lip extending outwardly from each side of said neck portion.

10. The cylinder of claim 9 wherein said retaining portion has a cross-sectional width greater than the width of said slot.

11. The cylinder of claim 10 wherein said retaining portion is compressible to permit insertion into said slot.

12. The cylinder of claim 11 wherein said retaining portion includes an elongated groove disposed between said retaining lips.

13. The cylinder of claim 10 wherein said neck portion has a cross-sectional width less than the width of said slot.

14. The cylinder of claim 1 wherein at least a part of said first portion of said seal member is constructed of a flexible, generally non-elastic material.

15. The cylinder of claim 14 including means for securing said seal member to said cylinder near the ends of said seal member.

16. The cylinder of claim 14 wherein at least a part of said first portion is constructed of a polymeric material having an elastic modulus greater than about $1\times10^5$.

17. The cylinder of claim 14 wherein at least a part of said first portion is constructed of a polypropylene.

18. The cylinder of claim 14 wherein said second portion is constructed of a flexible, compressible material.

19. The cylinder of claim 1 wherein said first portion comprises a support portion and a sealing portion connected with said support portion for engagement with the inner surface of said tubular member.

20. The cylinder of claim 19 wherein said support portion is constructed from a material having a durometer between about 90 and 110.

21. The cylinder of claim 20 wherein said second portion is constructed from a material having a durometer between about 50 and 80.

22. The cylinder of claim 21 wherein said sealing portion is constructed from a material having a durometer between about 50 and 80.

23. The cylinder of claim 19 wherein said support portion is comprised of a flexible steel material.

24. The cylinder of claim 1 including means for causing insertion of said second portion into and withdrawal of said second portion from said elongated slot in response to movement of said piston.

25. The cylinder of claim 1 including force transfer means connected with said piston and having a portion extending through said elongated slot.

26. The cylinder of claim 25 wherein said force transfer means includes means for causing insertion of said second portion into and withdrawal of said second portion from said elongated slot in response to movement of said piston.

27. The cylinder of claim 26 wherein said means for causing insertion of said second portion into said elongated slot includes a pair of spaced apart insertion rollers having a surface for engaging the side of said first portion facing the center of said tubular member.

28. The cylinder of claim 27 wherein said means for causing withdrawal of said second portion from said elongated slot includes a withdrawal roller disposed between said insertion rollers and having a surface for engaging the side of said first portion facing away from the center of said tubular member.

29. The cylinder of claim 28 wherein said insertion rollers and said withdrawl roller are rotatably supported by said force transfer means.

30. The cylinder of claim 1 wherein said first portion is comprised, in part, of a flexible steel material.

31. The cylinder of claim 1 wherein said second portion includes a retaining portion with a width greater than the width of a corresponding retaining portion of said elongated slot, so that upon insertion of said second portion into said elongated slot, said second portion will be retained therein in the absence of fluid pressure within said pressure chambers as a result of engagement between the retaining portion of said second portion and the corresponding retaining portion of said elongated slot.

32. A pressure cylinder comprising:

an elongated cylinder having a pair of pressure chambers and an elongated slot of predetermined width;

a piston reciprocally movable within said cylinder; and means for successively sealing said slot during movement of said piston including an elongated seal member having a first portion for sealing engagement with a portion of the inner surface of said cylinder on each side of said elongated slot and a second portion for insertion into at least a portion of said elongated slot, said second portion including a neck portion connected with said first portion and a retaining portion for insertion into said slot comprising a retaining lip extending outwardly from said neck portion on at least one side thereof and said elongated slot including an elongated retaining groove extending along at least one of the side edges of said slot for engagement with said retaining lip.

33. A pressure cylinder comprising:

an elongated cylinder having a pair of pressure chambers and an elongated slot of predetermined width;

a piston reciprocally movable within said cylinder; and means for successively sealing said slot during movement of said piston including an elongated seal member having a first portion for sealing engagement with a portion of the inner surface of said cylinder on each side of said elongated slot and a second portion for insertion into at least a portion of said elongated slot, said second portion including a neck portion connected with said first portion and a retaining portion for insertion into said slot comprising a retaining lip extending outwardly from each side of said neck portion and said elongated slot including an elongated retaining groove extending along each of its side edges for engagement with said retaining lips.

34. A pressure cylinder comprising:

an elongated cylinder having a pair of pressure chambers and an elongated slot of predetermined width;

a piston reciprocally movable within said cylinder; and means for successively sealing said slot during movement of said piston including an elongated seal member having a first portion for sealing engagement with a portion of the inner surface of said cylinder on each side of said elongated slot and a second portion for insertion into at least a portion of said elongated slot;

force transfer means connected with said piston and having a portion extending through said elongated slot, said force transfer means including means for causing insertion of said second portion into and withdrawal of said second portion from said elongated slot in response to movement of said piston wherein said means for causing insertion of said second portion into said elongated slot includes a pair of spaced apart insertion rollers having a surface for engaging the side of said first portion facing the center of said cylinder and said means for causing withdrawal of said second portion from said elongated slot includes a withdrawal roller disposed between said insertion rollers and having a surface for engaging the side of said first portion facing away from the center of said cylinder, said first portion including a pair of sealing lips for sealing engagement with said portion of the inner surface of said cylinder on each side of said elongated slot and said withdrawal roller including a pair of spaced surfaces for engaging said sealing lips.

35. An elongated seal member for sealing an elongated slot in a pressure cylinder of the type having an elongated tubular member with a pair of pressure chambers and a piston reciprocally movable within said tubular member, said seal member comprising:

a first portion comprising a pair of sealing lips for sealing engagement with a portion of the inner surface of said cylinder on each side of said elongated slot; and a second portion for insertion into at least a portion of said elongated slot, said second portion including a retaining portion with a width greater than the width between corresponding side wall portions of said elongated slot so that upon insertion of said second portion into said elongated slot, said second portion will be retained therein as a result of engagement between the retaining portion of said second portion and said side wall portions of said elongated slot.

36. The seal member of claim 35 wherein said second portion includes a neck portion connected with said first portion and a retaining portion for insertion into said slot comprising a retaining lip extending outwardly from said neck portion on at least one side thereof.

37. The seal member of claim 36 including a retaining lip extending outwardly from each side of said neck portion.

38. The seal member of claim 37 wherein said first portion comprises a support portion and a sealing portion connected with said support portion for engagement with the inner surface of said tubular member.

39. The seal member of claim 38 wherein said support portion is constructed from a material having a durometer between about 90 and 110.

40. The seal member of claim 39 wherein said second portion is constructed from a material having a durometer between about 50 and 80.

41. The seal member of claim 40 wherein said sealing portion is constructed from a material having a durometer between about 50 and 80.

42. The seal member of claim 35 wherein at least a part of said first portion of said seal member is constructed of a flexible, generally non-elastic material.

43. The seal member of claim 42 wherein at least a part of said first portion is constructed of a polymeric material having an elastic modulus greater than about $1\times10^5$.

44. The seal member of claim 35 wherein said first portion is comprised, in part, of a flexible steel material.

45. A rodless pressure cylinder comprising:

an elongated cylinder having a pair of pressure fluid chambers at each end and an elongated slot of predetermined width extending the entire length of the cylinder, said slot extending through the side wall of said cylinder and being defined by opposed edge portions of said side wall;

a piston disposed between and defining said pressure fluid chambers and being reciprocally movable within said cylinder in response to the introduction of fluid pressure into and exhaustion of fluid pressure from said pressure fluid chambers;

a force transfer bracket connected with said piston for movement therewith and having a portion extending through said elongated slot; and means for successively sealing said slot during movement of said piston including an elongated seal member connected at each end to said cylinder and having a first portion comprising a pair of sealing lips for sealing engagement with a portion of the inner surface of said cylinder on either side of said elongated slot and a second portion for insertion into said elongated slot for retaining the same in such position in the absence of fluid pressure within the pressure chambers, said second portion having a retaining portion with a width greater than the width between corresponding side wall portions of said elongated slot so that upon insertion of said second portion into said elongated slot, said second portion will be retained therein as a result of engagement between the retaining portion of said second portion and said side wall portions of said elongated slot.

* * * * *

US004545290B1

REEXAMINATION CERTIFICATE (1960th)

United States Patent [19]

Lieberman

[11] B1 4,545,290

[45] Certificate Issued Mar. 30, 1993

[54] PRESSURE CYLINDER

[75] Inventor: Walter G. Lieberman, Minneapolis, Minn.

[73] Assignee: Tol-O-Matic, Inc., Minneapolis, Minn.

Reexamination Request:
No. 90/002,642, Feb. 19, 1992

Reexamination Certificate for:

| | |
|---|---|
| Patent No.: | **4,545,290** |
| Issued: | **Oct. 8, 1985** |
| Appl. No.: | **564,990** |
| Filed: | **Dec. 23, 1983** |

[51] Int. Cl.[5] ..... F01B 29/00
[52] U.S. Cl. ..... 92/88; 277/DIG. 7
[58] Field of Search ..... 92/88, 168; 277/DIG. 7

[56] References Cited

U.S. PATENT DOCUMENTS 4,555,980 12/1985 Hoglund ..... 92/88

*Primary Examiner*—Thomas E. Denion

[57] ABSTRACT

A fluid pressure cylinder of the rodless type having a reciprocally movable piston, an elongated slot within the cylinder and an improved sealing element for successively sealing the elongated slot during movement of the piston. The improved sealing element is constructed of a generally flexible material and includes a sealing portion for creating a seal against the inner side wall of the cylinder adjacent to the elongated slot and a portion which is adapted for at least partial insertion within the slot so as to retain the seal member within the slot during an absence of pressure within the cylinder.

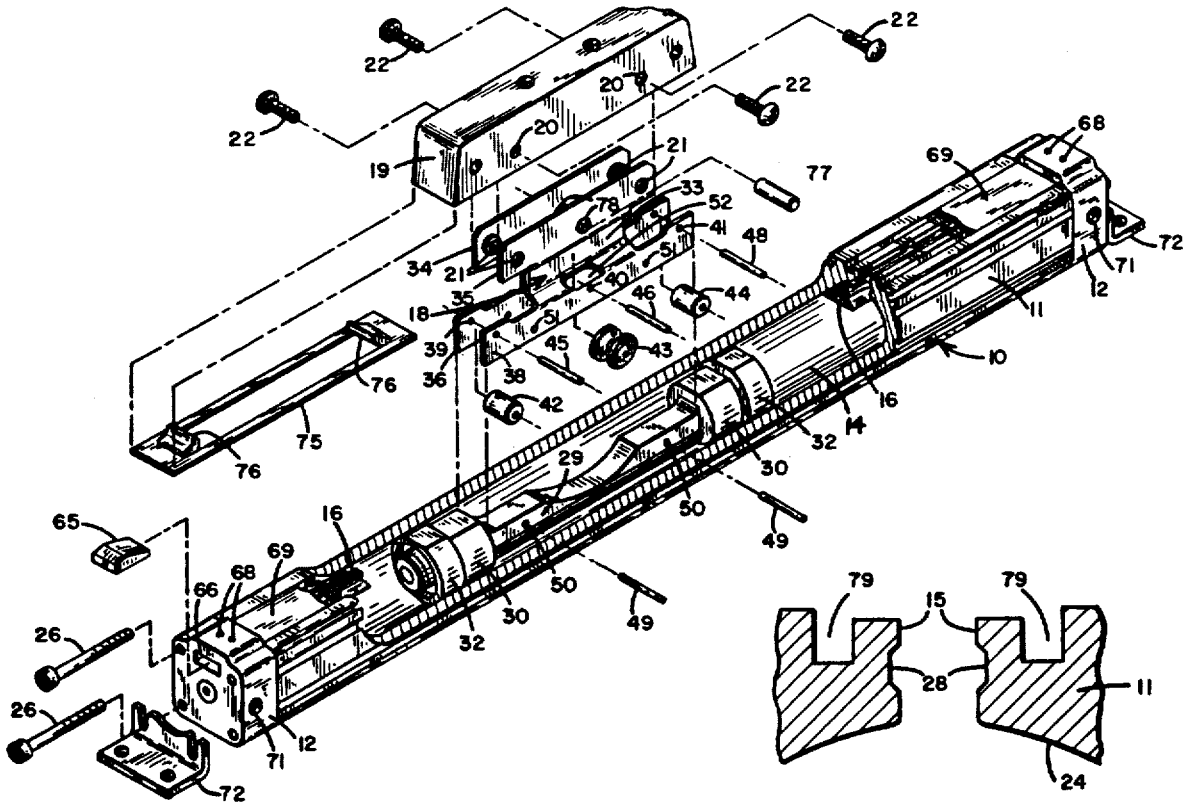

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 32-34 is confirmed.

Claims 1, 4-6, 27, 31, 35-36, 42 and 45 are determined to be patentable as amended.

Claims 2-3, 7-26, 28-30, 37-41 and 43-44, dependent on an amended claim, are determined to be patentable.

1. A pressure cylinder comprising:

an elongated tubular member having a side wall, a pair of pressure chambers and an elongated slot extending through said side wall and defined by opposed edge portions of said side, *said slot having a narrow portion with a width defined by first corresponding opposed edge portions and a wider portion with a width defined by second corresponding opposed edge portions;* a piston reciprocally movable within said tubular member; and means for successively sealing said slot during movement of said piston including an elongated seal member having a first portion for sealing engagement with a portion of the inner surface of said tubular member on each side of said elongated slot and a second portion for insertion into said elongated slot, said second portion including a retaining portion with a width greater than the width [between corresponding side wall portions of said elongated slot] *of said narrow portion* so that upon insertion of said second portion into said elongated slot, said second portion will be retained therein as a result of engagement between the retaining portion of said second [piston] *portion* and said [side wall portions of said elongated slot] *narrow portion.*

4. The cylinder of claim 1 wherein said first portion has a width greater than the width of said [elongated slot] *narrow portion.*

5. The cylinder of claim 1 *wherein said wider portion includes an elongated retaining groove extending along at least one of the side walls of said slot and* wherein said second portion is compressible to permit insertion into said elongated slot *and past said narrow portion.*

6. [The] *A pressure* cylinder [of claim 1 wherein] *comprising:*

*an elongated tubular member having a side wall, a pair of pressure chambers and an elongated slot extending through said side wall and defined by opposed edge portions of said side wall;*

*a piston reciprocally movable within said tubular member;*

*means for successively sealing said slot during movement of said piston including an elongated seal member having a first portion for sealing engagement with a portion of the inner surface of said tubular member on each side of said elongated slot and a second portion for insertion into said elongated slot; and* said second portion [includes] *including* a neck portion connected with said first portion and a retaining portion for insertion into said slot comprising a retaining lip extended outwardly from said neck portion on at least one side thereof *and having a width greater than the width between corresponding side wall portions of said elongated slot so that upon insertion of said second portion into said elongated slot, said second portion will be retained therein as a result of engagement between the retaining portion of said second portion and said side wall portions of said elongated slot.*

27. [The] *A pressure* cylinder [of claim 26] *comprising:*

*an elongated tubular member having a side wall, a pair of pressure chambers and an elongated slot extending through said side wall and defined by opposed edge portions of said side wall;*

*a piston reciprocally movable within said tubular member;*

*means for successively sealing said slot during movement of said piston including an elongated seal member having a first portion for sealing engagement with a portion of the inner surface of said tubular member on each side of said elongated slot and a second portion for insertion into said elongated slot,*

*said second portion including a retaining portion with a width greater than the width between corresponding side wall portions of said elongated slot so that upon insertion of said second portion into said elongated slot, said second portion will be retained therein as a result of engagement between the retaining portion of said second portion and said side wall portions of said elongated slot,*

*force transfer means connected with said piston and having a portion extending through said elongated slot wherein said force transfer means includes means for causing insertion of said second portion into and withdrawal of said second portion from said elongated slot in response to movement of said piston and* wherein said means for causing insertion of said second portion into said elongated slot includes a pair of spaced apart insertion rollers having a surface for engaging the side of said first portion facing the center of said tubular member.

31. The cylinder of claim 1 wherein [second portion includes a] *said wider portion is adapted to receive a portion of* said retaining portion [with a width greater than the width of a corresponding retaining portion of said elongated slot], so that upon insertion of said second portion into said elongated slot, said second portion will be retained therein in the absence of fluid pressure within said pressure chambers as a result of engagement between the retaining portion of said second portion and [the corresponding retaining portion of said elongated slot] *said narrow portion.*

35. An elongated seal member for sealing an elongated slot in a pressure cylinder of the type having an elongated tubular member with a pair of pressure chambers and a piston reciprocally movable within said tubular member *and wherein said slot includes a pair of side walls and an elongated recess in at least one of the sidewalls,* said seal member comprising:

a first portion comprising a pair of sealing lips for sealing engagement with a portion of the inner surface of said cylinder on each side of said elongated slot; and a second portion for insertion into at least a portion of said elongated slot, said second portion including a retaining portion with a width greater than the width between corresponding side wall portions of said elongated slot so that upon insertion of said second portion into said elongated slot, said second portion will be *received in said elongated recess and* retained [therein] *in said slot* as a result of engagement between the retaining portion of said second portion and said side wall portions of said elongated slot.

36. [The] *An elongated* seal member [of claim 35 wherein] *for sealing an elongated slot in a pressure cylinder of the type having an elongated tubular member with a pair of pressure chambers and a piston reciprocally movable within said tubular member, said seal member comprising:*

*a first portion comprising a pair of sealing lips for sealing engagement with a portion of the inner surface of said cylinder on each side of said elongated slot; and*

*a second portion for insertion into at least a portion of said elongated slot,* said second portion [includes] *including* a neck portion connected with said first portion and a retaining portion for insertion into said slot comprising a retaining lip extending outwardly from said neck portion on at least one side thereof *and having a width greater than the width between corresponding side wall portions of said elongated slot so that upon insertion of said second portion into said elongated slot, said second portion will be retained therein as a result of engagement between the retaining portion of said second portion and said side wall portions of said elongated slot.*

42. [The] *An elongated* seal member [of claim 35] *for sealing an elongated slot in a pressure cylinder of the type having an elongated tubular member with a pair of pressure chambers and a piston reciprocally movable within said tubular member and wherein said slot includes a pair of side walls and an elongated recess in at least one of the sidewalls, said seal member comprising:*

*a first portion comprising a pair of sealing lips for sealing engagement with a portion of the inner surface of said cylinder on each side of said elongated slot; and*

*a second portion for insertion into at least a portion of said elongated slot, said second portion including a retaining portion with a width greater than the width between corresponding side wall portions of said elongated slot so that upon insertion of said second portion into said elongated slot, said second portion will be received in said elongated recess and retained in said slot as a result of engagement between the retaining portion of said second portion and said side wall portions of said elongated slot* wherein at least a part of said first portion of said seal member is constructed of a flexible, generally non-elastic material.

45. A rodless pressure cylinder comprising:

an elongated cylinder having a pair of pressure fluid chambers at each end and an elongated slot of predetermined width extending the entire length of the cylinder, said slot extending through the side wall of said cylinder and being defined by opposed edge portions of said side wall, *said slot having an elongated recess in at least one of said side walls;* a piston disposed between and defining said pressure fluid chambers and being reciprocally movable within said cylinder in response to the introduction of fluid pressure into and exhaustion of fluid pressure from said pressure fluid chambers;

a force transfer bracket connected with said piston for movement therewith and having a portion extending through said elongated slot; and means for successively sealing said slot during movement of said piston including an elongated seal member connected at each end to said cylinder and having a first portion comprising a pair of sealing lips for sealing engagement with a portion of the inner surface of said cylinder on either side of said elongated slot and a second portion for insertion into said elongated slot for retaining the same in such position in the absence of fluid pressure within the pressure chambers, said second portion having a retaining portion with a width greater than the width between corresponding side wall portions of said elongated slot so that upon insertion of said second portion into said elongated slot, said [second] *retaining* portion will be *received in said elongated recess and* retained [therein] *in said slot* as result of engagement between the retaining portion of said second portion and said side wall portions of said elongated slot.

* * * * *